US008168280B2

(12) United States Patent
Thiele

(10) Patent No.: US 8,168,280 B2
(45) Date of Patent: May 1, 2012

(54) LINT ROLLER

(75) Inventor: John L. Thiele, Newport, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 832 days.

(21) Appl. No.: 12/044,153

(22) Filed: Mar. 7, 2008

(65) Prior Publication Data

US 2009/0226657 A1 Sep. 10, 2009

(51) Int. Cl.
*B32B 33/00* (2006.01)
*A47L 25/00* (2006.01)

(52) U.S. Cl. ..... 428/42.3; 428/40.1; 428/41.8; 428/41.9; 428/42.2; 428/43; 428/192; 428/195.1; 428/906; 15/104.002

(58) Field of Classification Search ..... 15/104.002
See application file for complete search history.

(56) References Cited

U.S. PATENT DOCUMENTS

| | | | | |
|---|---|---|---|---|
| 4,427,726 | A * | 1/1984 | Wolfrum | 428/43 |
| 4,562,102 | A | 12/1985 | Rabuse et al. | |
| 5,213,565 | A * | 5/1993 | Rollband | 602/41 |
| 5,763,038 | A * | 6/1998 | Wood | 428/43 |
| 5,878,457 | A | 3/1999 | Cox et al. | |
| 6,756,102 | B1 | 6/2004 | Galo | |
| 6,865,765 | B2 | 3/2005 | Aalbers | |
| 6,954,963 | B2 | 10/2005 | McKay | |
| 7,090,908 | B1 | 8/2006 | McKay | |
| 7,107,643 | B1 | 9/2006 | McKay | |
| 7,188,384 | B2 | 3/2007 | McKay | |
| 7,413,786 | B2 * | 8/2008 | Wada et al. | 428/40.1 |
| 2002/0088070 | A1 * | 7/2002 | Cho | 15/104.002 |
| 2005/0050661 | A1 * | 3/2005 | McKay et al. | 15/104.002 |
| 2006/0003129 | A1 * | 1/2006 | Thiele et al. | 428/40.1 |
| 2008/0248232 | A1 * | 10/2008 | Wu et al. | 428/43 |
| 2009/0126133 | A1 * | 5/2009 | Ryu | 15/104.002 |

FOREIGN PATENT DOCUMENTS

| | | | |
|---|---|---|---|
| JP | 2006304912 | A * | 11/2006 |
| JP | 2006304912 | A * | 11/2006 |
| KR | 1020070114790 | A * | 1/2008 |

OTHER PUBLICATIONS

Translation of KR 10-2007-0114790 A, Jan. 2008.*
English Abstract for JP 2006-304912 A, Nov. 2006.*

* cited by examiner

*Primary Examiner* — David Sample
*Assistant Examiner* — Jeff Vonch
(74) *Attorney, Agent, or Firm* — Trisha D. Adamson

(57) ABSTRACT

Unwinding, or "lanemarking," of lint roll tape during use can be greatly minimized or eliminated by providing a roll of tape that comprises a backing having a first side and a second side, an adhesive on the first side of the backing, a plurality of separation lines separating the tape into sheets, a low adhesion zone adjacent each separation lines extending in an upweb direction along the tape from the separation line. The low adhesion zone has a lower adhesion than the adhesive. Each separation line extends beyond the next adjacent and underlying low adhesion zone.

13 Claims, 5 Drawing Sheets

LINT ROLLER

BACKGROUND

The present disclosure relates to a lint roller. In particular, the present disclosure relates to a lint roller including a leading edge containing a low adhesion zone.

Lint removal tape is used on a roll to remove lint and other small particles from surfaces such as fabric, carpeting, furniture, etc. The tape is removed from the roll only after use, to discard it. In roll form, lint removal tape typically has the adhesive side of the tape wound outwardly for use. A roll of lint removal tape is generally used on an applicator.

Rolls of tape are often perforated for easier removal of individual sheets. FIG. 1 shows a conventional roll of lint tape 1, wherein each sheet includes a separation line 2 to allow for easy removal of the sheet. As shown by FIG. 1, the tape may include edges not coated with adhesive that will create a small tab for grasping the outer most sheet during removal. FIG. 2 shows a tape construction where each line of perforations 2 advances with each additional wrap of tape to create sheets having progressively increasing lengths. When the sheets are wound into a roll, each sheet is longer than the sheet underneath it by an overlap length.

In use, the tape roll is rolled back and forth over a surface to remove loose particles of lint and other debris. The debris clings to the exposed adhesive of the top sheet of the tape roll, which is then removed and discarded, revealing a fresh tape sheet for the next use. In use, the sheets should not separate or unwind from the roll, yet the sheets must be easily removable from the roll when discarding. When such a tape roll is used to clean a smooth or flat surface, it often fails because the tape sticks aggressively to the surface and unwinds from the roll. This failure is referred to as "lanemarking."

A variety of methods have been used to minimize lanemarking. The adhesive used on the tape could be made less sticky. The backing used may be highly structured, so that during use on a flat surface, the adhesive contacts the flat surface at fewer points. However, a less sticky adhesive and/or decreased contact with the surface being cleaned may harm the roller's ability to pick up and retain lint and debris. Another option is to select a release coating (on the back side of the tape sheet) that adheres more strongly to the adhesive. However, the sheets become difficult to remove when trying to expose a clean sheet. Tape wound in a spiral pattern minimizes lanemarking because only a small corner of the lint tape is lifted to start removing a sheet. However, for these rollers each spiral-wound sheet does not fully cover the underlying sheet. Therefore, when a used, dirty sheet is removed from the spiral wound roller, a pattern of dirt is still exposed on the underlying sheet. Lanemarking can be minimized by mechanical means. However, these systems are inconvenient.

SUMMARY

Unwinding, or "lanemarking," of a lint roll tape during use can be greatly minimized or even eliminated by providing a low adhesion zone at the separation line of a roll of tape. Including the low adhesion zone at the separation line minimizes the adhesion of the tape at the separation line of the outermost sheet to the surface being cleaned. Also, when the low adhesion zone slightly overlaps the underlying low adhesion zone, the low adhesion zone of the outermost overlying sheet is secured by the underlying adhesive. Further, the low adhesion zone located adjacent the separation line prevents the separation line from strongly adhering to the surface being cleaned.

As used throughout this disclosure "low adhesion zone" will mean an area having lower adhesion than the adhesive areas of the main body of the roller. The low adhesion zone may have an adhesion ranging from essentially zero adhesion to slightly less than the adhesion of the adhesive area of the main body of the roller.

In one embodiment, the roll of tape comprises a backing having a first side and a second side, an adhesive on the first side of the backing, a plurality of separation lines separating the tape into sheets, a low adhesion zone adjacent each separation lines extending in an upweb direction along the tape from the separation line. The low adhesion zone has a lower adhesion than the adhesive. Each separation line extends beyond the next adjacent and underlying low adhesion zone.

While the above-identified drawings and figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention.

The figures may not be drawn to scale.

DETAILED DESCRIPTION

Figure 1:
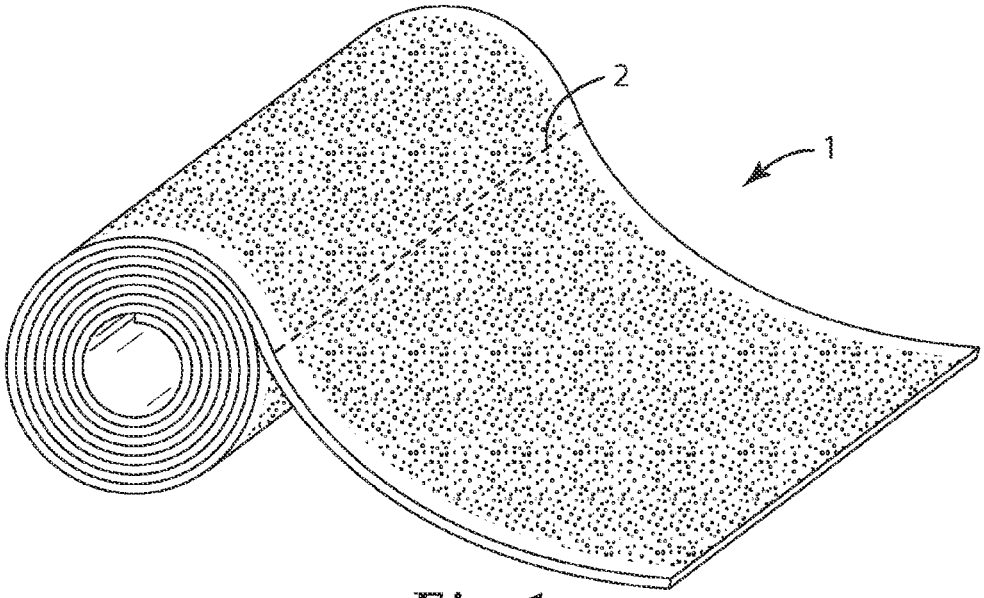
Fig. 1 PRIOR ART
FIG. 1 is a perspective view of a conventional lint roll.
Figure 2:
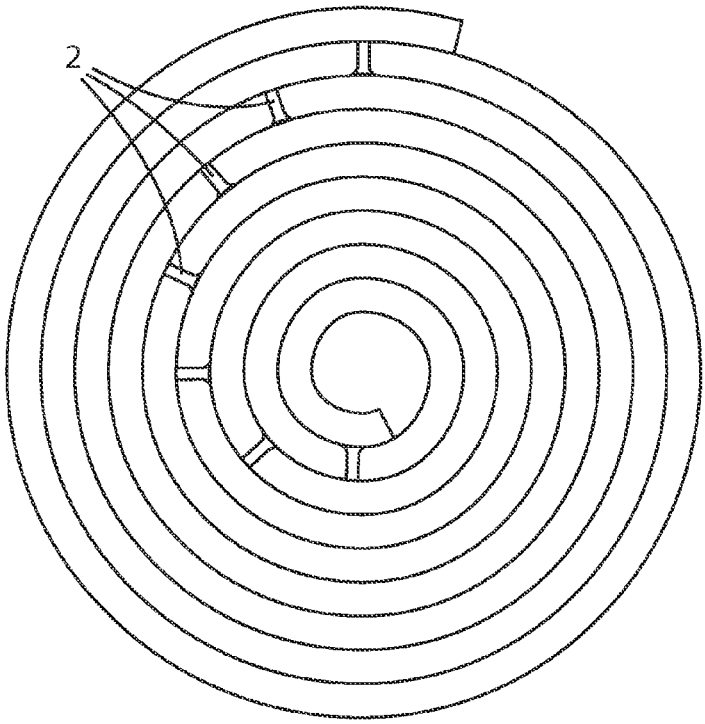
Fig. 2 PRIOR ART
FIG. 2 is a side view of a lint roll with progressively arranged separation lines.
Figure 3:
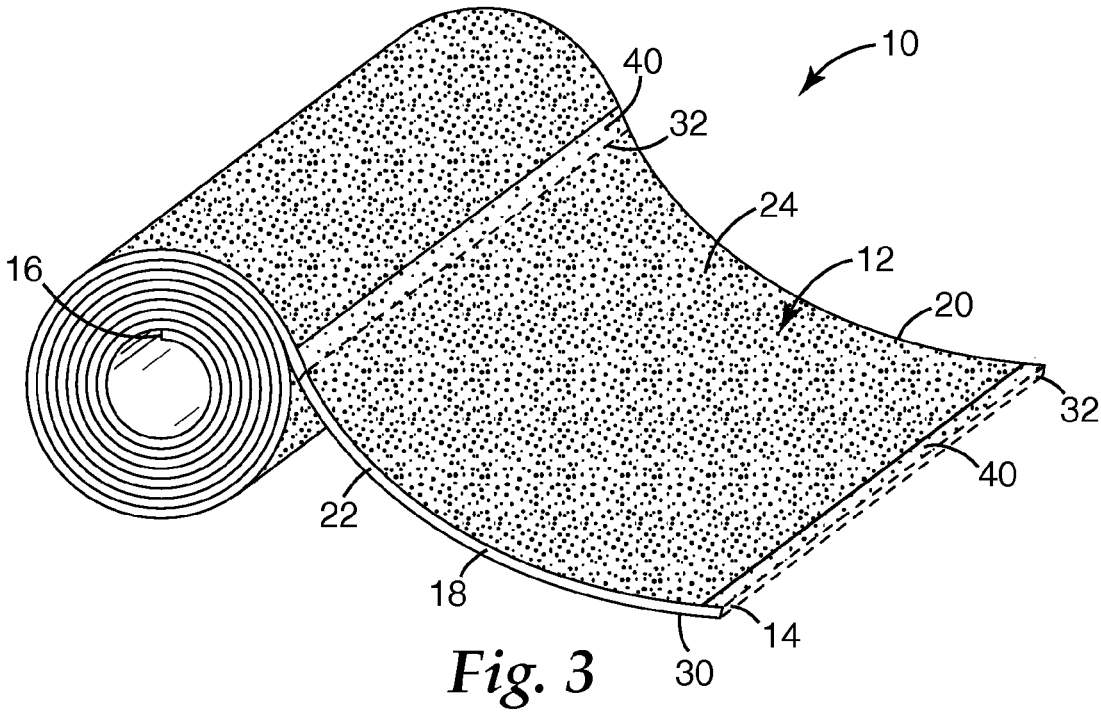
FIG. 3 is a perspective view of a first embodiment of a lint roll.

FIGS. 3-6 show a roll 10 of lint removal tape 12. As shown in FIG. 3, the tape 12 has a first longitudinal end 14, a second longitudinal end 16, a first side edge 18, and a second side edge 20. The tape is formed of at least two layers, a backing layer 22 and an adhesive layer 24. The tape 12 is formable into a roll having a plurality of wraps.

The backing layer 22 has a first side 26 and a second side 28 and can be made of, for example, paper or plastic film. Suitable paper backings include saturated flatstock and crepe. Suitable plastic film backings include polypropylene, polyethylene, copolymers of polypropylene and polyethylene, polyesters, and vinyl acetates. The polypropylene can be cast polypropylene, calendared polypropylene, biaxially oriented polypropylene (BOPP) or simultaneously biaxially oriented polypropylene (SBOPP). The backing material can be compostible, degradable, colored, printed, and can be of different surface textures or embossed, such as disclosed in U.S. Pat. No. 6,865,765 to Aalbers.

The adhesive layer 24 is placed on the first side 26 of the backing layer 22. It can be formed on the entire first side, or the backing layer can be uncoated by adhesive along one or both side edges. Alternatively, the side edges can be adhesive coated and then detackified by using waxes, lacquers, or inks for example.

Useful adhesives according to the present invention include all pressure sensitive adhesives. Pressure sensitive adhesives are normally tacky at room temperature and can be adhered to a surface by application of, at most, light finger pressure. Examples of adhesives useful in the invention include those based on general compositions of polyacrylate; polyvinyl ether; diene-containing rubber such as natural rubber, polyisoprene, and polyisobutylene; polychloroprene; butyl rubber; butadiene-acrylonitrile polymer; thermoplastic elastomer; block copolymers such as styrene-isoprene and styrene-isoprene-styrene block copolymers, styrene-butadiene-styrene block copolymers, ethylene-propylene-diene polymers, and styrene-butadiene polymer; poly-alpha-olefin; amorphous polyolefin; silicone; ethylene-containing copolymer such as ethylene vinyl acetate, ethylacrylate, and ethyl methacrylate; polyurethane; polyamide; epoxy; polyvinylpyrrolidone and vinylpyrrolidone copolymers; polyesters; and mixtures of the above. Additionally, the adhesives can contain additives such as tackifiers, plasticizers, oils, fillers, antioxidants, stabilizers, pigments, diffusing particles, curatives, perfumes, microcapsules, and solvents. The adhesive can include hotmelt-coated formulations, transfer-coated formulations, solvent-coated formulations, and latex formulations.

The tape 12 is formed into a roll 10 having a plurality of wraps with the adhesive layer 24 facing outwardly by rolling the tape on only itself. Support material, such as a core, a liner, or any other material that could lend support and provide rigidity and strength to the roll of tape, is optional. In the illustrated embodiments, none is used.

The roll 10 of tape could also include a third layer. A release material or low adhesion backside (LAB) layer 30 can be formed on the second side 28 of the backing layer 22 to facilitate removing the outer wrap of tape from the roll 10. Suitable LAB layers include silicones, fluorochemicals, acrylates, and polyvinylacetates. Numerous other layers can be added to the tape, such as primers to increase the adhesion of adhesive layer 24 to backing layer 22. Also, printed material can be located on the first side of the backing layer under the adhesive, or on the second side of the backing layer either under or over any LAB layer 30. This printed material can be advertising, instructions, or other information. The tape could contain deodorants, perfumes, antistatic materials, and encapsulated cleaning chemicals. Also, the backing layer 22 can be modified by flame treatment, corona treatment, or roughening.

A plurality of separation lines 32 divide the tape into discrete sheets, to help remove the outer wrap of tape from the roll 10. Each separation line 32 can be formed from any number of through-cuts ranging from a micro-perforated line to a continuous, nearly complete cut from the first side edge 18 to the second side edge 20. In this embodiment, each separation line 32 is a perforated line. The separation lines 32 are made before the tape 12 is formed into a roll 10. Each sheet is defined by the first and second side edges 18, 20, and two successive separation lines 32.

There are n separation lines 32 extending across at least most of the width of the tape 12 between the first and second side edges 18, 20 to separate the tape into n+1 sheets. The plurality of separation lines 32 can extend partially or completely across the width of the tape. The sheets may have progressively increasing lengths, uniform length, or random length from the first longitudinal end 14 to the second longitudinal end 16 such that when the sheets are wound into a roll each separation line 32 overlaps the successive, underlying separation line 32.

Figure 4:
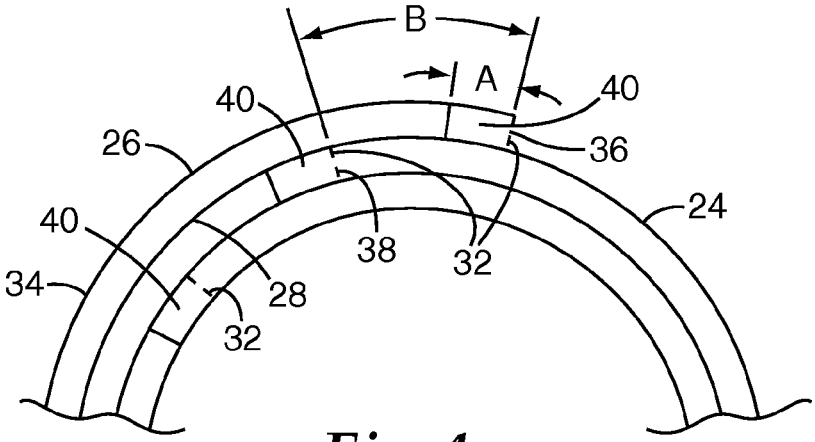
FIG. 4 is a side view of FIG. 3.

When the tape 12 forms a roll 10, the outermost sheet 34 has a free, leading edge 36 and a trailing end 38. As shown in FIG. 4, the outermost sheet 34 covers the underlying separation lines 32. Starting from the inside of the roll 10, each separation lines 32 advances with each additional wrap of tape.

Adjacent the separation line 32 is a low adhesion zone 40. The low adhesion zone 40 includes an adhesion less that the adhesive 24 section of the tape 12. There are a variety of ways to achieve an adhesion in the low adhesion zone 40 less than the adhesion of the adhesive 24 of the tape 12. In one embodiment, the adhesive 24 may be omitted entirely from being applied in the low adhesion zone 40. In such an instance, the low adhesion zone 40 essentially has no adhesion. In another embodiment, adhesive 24 may be a coating of a higher adhesion adhesive, while a lower adhesion adhesive can be applied in the low adhesion zone 40. In another embodiment, the adhesive 24 within the low adhesion zone 40 can be detackified. To detackify the adhesive 24 an adhesive coating of ink, varnish, powder, or wax can be applied over the adhesive 24 in the desired low adhesion zone 40. It is possible to depict the low adhesion zone 40 by a color different that the adhesive 24 of the tape 12.

As shown in FIGS. 3 and 4, the low adhesion zone begins at the separation line 32 and extends a distance A in an upweb direction. In this embodiment, the low adhesion zone 40 extends entirely and continuously from the first size edge 18 to the second side edge 20 of the tape 12. Also in this embodiment, the low adhesion zone 40 extends uniformly from the separation line 32 along the length from the first side edge 18 to the second side edge 20 such that the low adhesion zone 40 is generally rectangular.

As discussed above, the separation lines 32 overlap one another. It is desirable to cause enough overlap that the low adhesion zone 40 is at least partially secured to the underlying adhesive 24 (which may actually be part of the same sheet). Without an overlap, where the low adhesion zones 40 of the outermost sheet 34 is arranged on top of the underlying low adhesion zone 40, a flap or tab may be formed because the outer low adhesion zone 40 is not secured down by the underlying adhesive. As shown by FIG. 4, distance B is the side sectional distance from the free leading edge 36 to the next low adhesion zone 40. Including a low adhesion zone 40 at the free leading edge 36 minimizes the adhesion of the tape 12 at the leading edge 36 to the surface being cleaned. Also, by including some distance B between the outermost low adhesion zone and the underlying low adhesion zone, the overlapping low adhesion zone 40 will be secured down by the underlying adhesive 24. The low adhesion zone 40 at the free leading edge 36 is more likely to be secured in place by the underlying adhesive than to adhere to the surface being cleaned. Therefore, the tape 12 will be less likely to unwind and lanemark in use.

Figure 5:
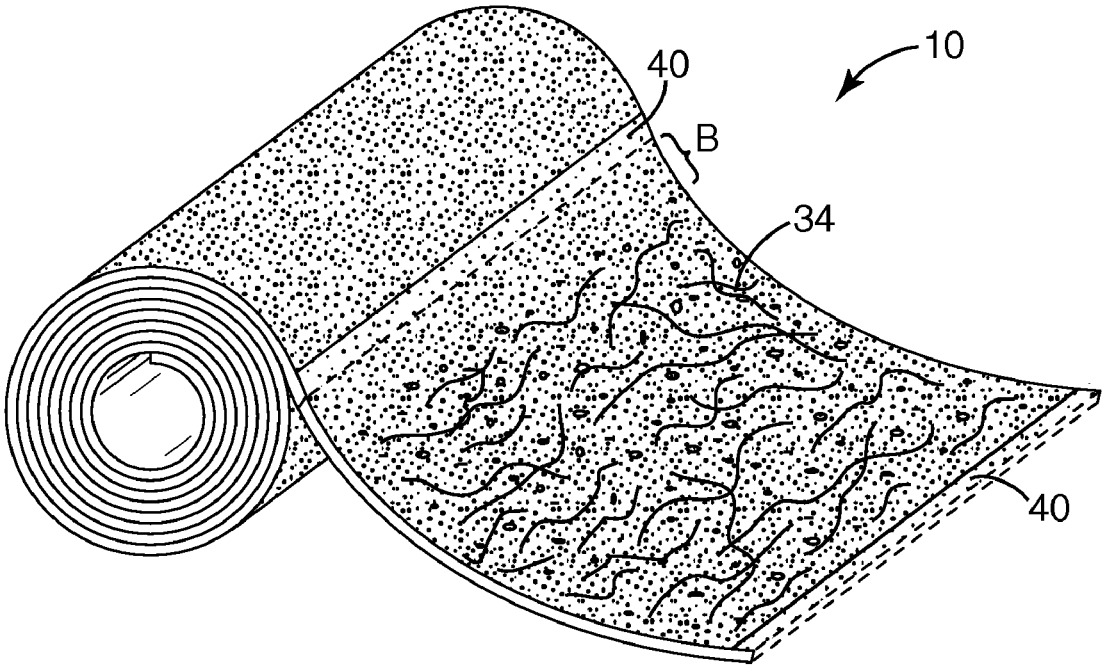
FIG. 5 is a perspective view of a used sheet of the lint roll of FIG. 3.
Figure 6:
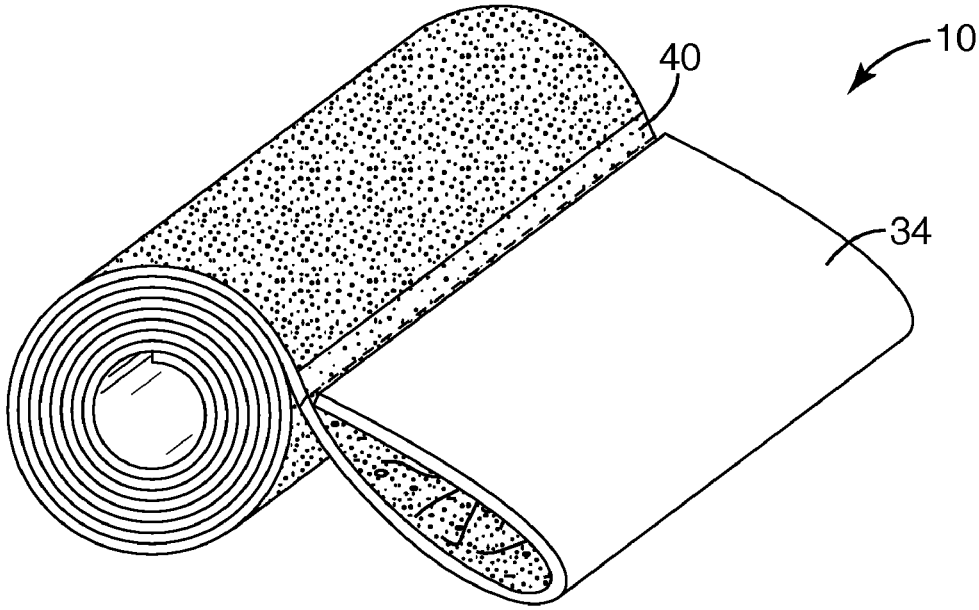
FIG. 6 is a perspective view showing removal of the used sheet of FIG. 5.

FIG. 5 shows a used outer sheet 34 being pulled from and removed from the roll 10. There is a portion of the outer sheet 34 that is not dirty because it was covered by the overlying outer sheet 34. The clean portion is representative of distance B, the distance from the free leading edge 36 to the next low adhesion zone 40. Distance B is a clean area of the sheet 34 that gives the user a clean area to touch when pulling and removing the otherwise dirty sheet 34 from the roll 10. As shown in FIG. 6, the outer sheet 34 can be pulled out and folded over itself to contain the lint and debris, while the user can pull and remove the sheet 34 at the clean distance B. Also, the clean distance B provides an adhesive surface for sticking to the dirty sheet 34.

Figure 7:
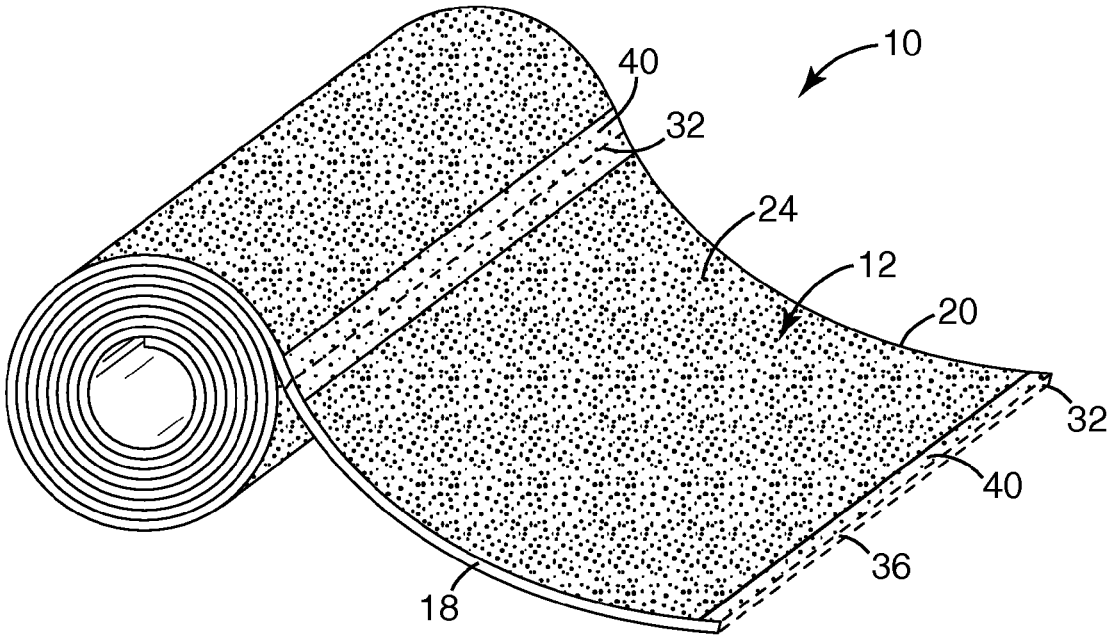
FIG. 7 is a perspective view of a second embodiment of a lint roll.
Figure 8:
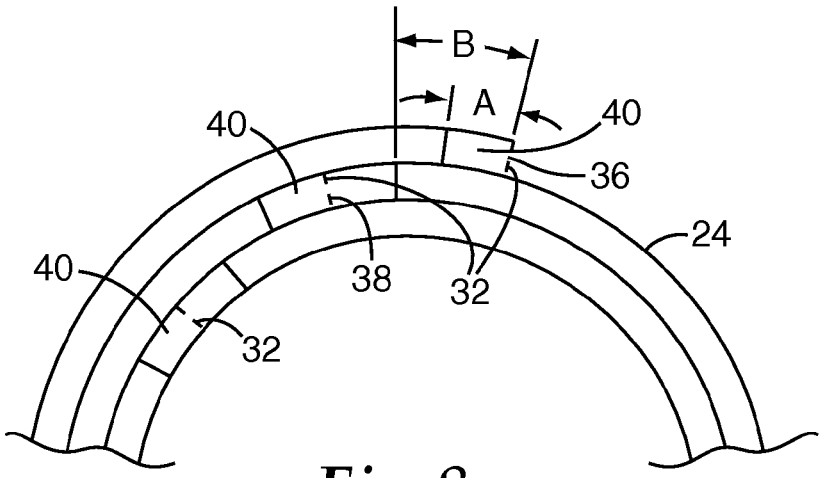
FIG. 8 is a side view of FIG. 7.

FIGS. 7 and 8 show another embodiment of a roll 10 of lint removal tape 12. Similar reference numbers are used to denote similar features throughout the figures. The low adhesion zone 40 is adjacent the separation line 32. As shown in FIGS. 7 and 8, the low adhesion zone 40 extends a distance A from the separation line 32 in an upweb direction and a distance from the separation line 32 in a downweb direction. In other words, the separation line 32 is within the low adhesion zone 40. For greater tolerances during manufacturability, it is more desirable to include the separation line 32 within the area of the low adhesion zone 40. In this embodiment, the low adhesion zone 40 extends entirely and continuously from the first size edge 18 to the second side edge 20 of the tape 12. Also, in this embodiment the low adhesion zone 40 extends uniformly from the separation line 32, along the length from the first size edge 18 to the second side edge 20 such that the low adhesion zone 40 is generally rectangular.

As discussed above, the separation lines 32 overlap one another. It is desirable to cause enough overlap so that the low adhesion zone 40 is at least partially secured to the underlying adhesive 24. As shown by FIG. 8, distance B is the distance from the free leading edge 36 to the next low adhesion zone 40. Including a low adhesion zone 40 at the free leading edge 36 minimizes the adhesion at the leading edge 36 with the surface being cleaned. Also, by including some distance B between the outermost low adhesion zone and the underlying low adhesion zone, the overlapping low adhesion zone 40 will be secured to the adhesive 24 of the underlying layer. The low adhesion zone 40 at the free leading edge 36 is more likely to be secured to the underlying adhesive than to adhere to the surface being cleaned. Therefore, the tape 12 will be less likely to unwind and lanemark in use.

Figure 9:
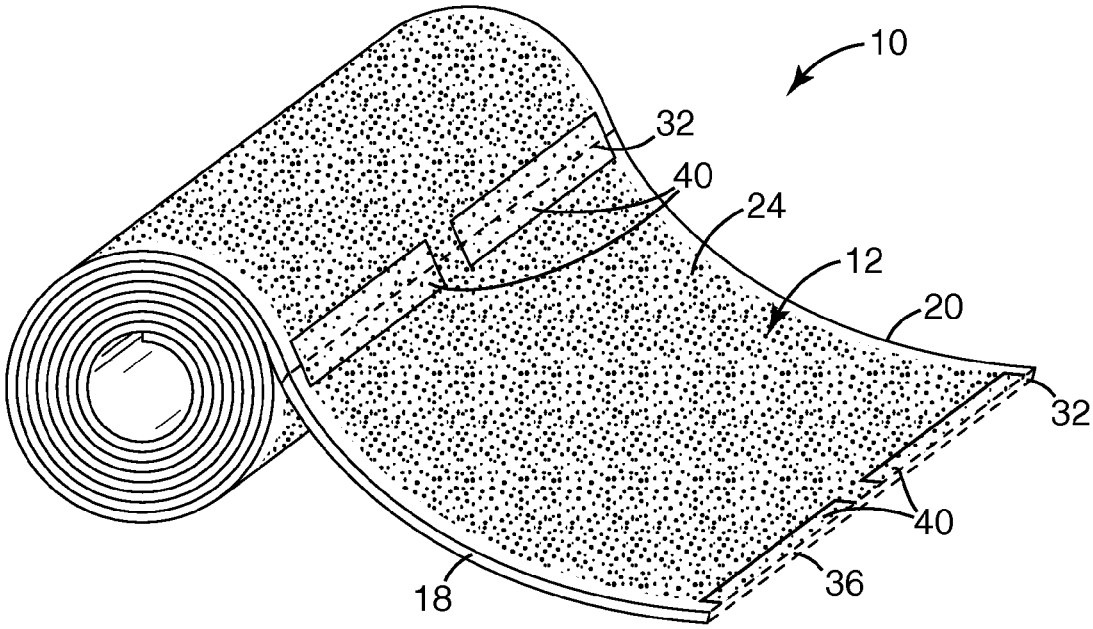
FIG. 9 is a perspective view of a third embodiment of a lint roll.
Figure 10:
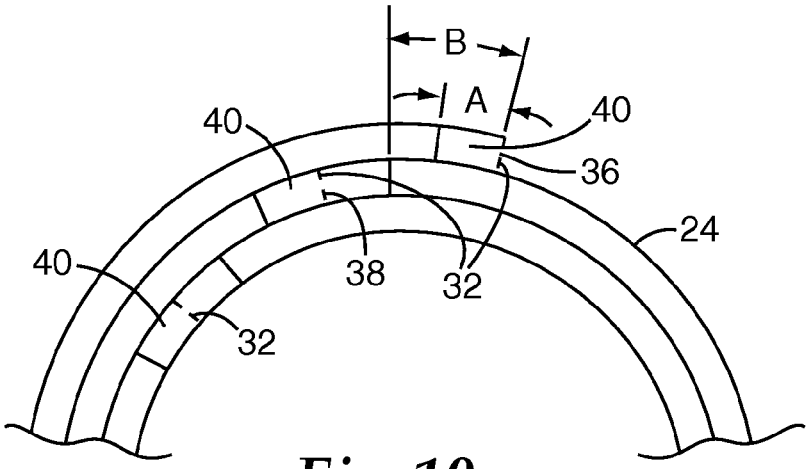
FIG. 10 is a side view of FIG. 9.

FIGS. 9 and 10 show another embodiment of a roll 10 of lint removal tape 12. Similar reference numbers are used to denote similar features throughout the figures. The low adhesion zone 40 is adjacent the separation line 32. Similar to the low adhesion zone shown in FIGS. 7 and 8, the low adhesion zone 40 extends on both sides of the separation line 32. In this embodiment, the low adhesion zone 40 extends partially and discontinuously from the first size edge 18 to the second side edge 20 of the tape 12. As opposed to the prior embodiments where the low adhesion zone 40 extended along the entire separation line 32, in this embodiment, the low adhesion zone 40 extends along less than the entire separation line 32. In this embodiment, the area immediately adjacent to the first side edge 18 and second side edge 20 is not included within the low adhesion zone 40. This portion of the tape 12, along the entire length of the tape, is also not coated with any adhesive. Additionally, in this embodiment, the low adhesion zone 40 is discontinuous in a midsection, leaving exposed adhesive 24 adjacent the separation line 32.

As discussed above, the separation lines 32 overlap one another. It is desirable to cause enough overlap so that the low adhesion zone 40 is at least partially secured to the underlying adhesive 24. As shown by FIG. 10, distance B is the distance from the free leading edge 36 to the next low adhesion zone 40. Including a low adhesion zone 40 at the free leading edge 36 minimizes the adhesion at the leading edge 36 with the surface being cleaned. Also, by including some distance B between the outer most low adhesion zone and the underlying low adhesion zone, the overlapping low adhesion zone 40 will be secured down by the adhesive 24 of the underlying layer. The low adhesion zone 40 at the free leading edge 36 is more likely to be secured in place by the underlying adhesive than to adhere to the surface being cleaned. Therefore, the tape 12 will be less likely to unwind and lanemark in use.

The low adhesion zone 40 may extend across 100% of the tape 12 along the separation line 32, such as shown in the embodiments of FIGS. 3-8. To provide the desirable aspects of minimizing unwinding and lanemarking caused by the free leading edge 36 of the outer sheet 34 securing more strongly to the surface being cleaned, it is possible to include the low adhesion zone 40 along less than 100% of the separation line 32. In one embodiment, the low adhesion zone 40 extends along more than 98% of the separation line 32. In one embodiment, the low adhesion zone 40 extends along more than 95% of the separation line 32. In one embodiment, the low adhesion zone extends along more than 90% of the separation line 32.

As depicted, the low adhesion zone 40 is shown rectangular. It is understood that any variety of sizes, shape and number of low adhesion zones 40 may be suitable so long as a portion of the low adhesion zone 40 is along a portion of the separation line 32. For example the low adhesion zone 40 may be oval, circular, wavy, zigzag, square, stars, hearts, small pixels of a shape like circles, stripes, or any variety of random or repeating pattern.

The size of distances A and B depend on a number of factors including the adhesion of the adhesive 24, the adhesion of the low adhesion zone 40, the surfaces that the roller will be applied over, etc. Also, it is understood that because the low adhesion zone 40 is not necessarily rectangular, then distance A and/or B may vary along the length of the separation line.

Generally, the free leading edge 36 of the outer sheet 34 extends beyond the underlying low adhesion zone 40. Distance B should be a positive number, indicating that the free leading edge 36 has extended beyond the underlying low adhesion zone 40. In one embodiment, especially when the low adhesion zone 40 is rectangular, distance A and distance B are approximately equal. If distance B is too small, then the leading edge may not be sufficiently secured to the underlying adhesive. If distance B is much larger than A, then the unused portion (refer to FIG. 5 where distance B is depicted) becomes larger and is wasted material that is not used for cleaning.

In one embodiment, distance A is at least 1 mm and distance B is at least 1 mm. In another embodiment, distance A is at least 5 mm and distance B is at least 5 mm. In another embodiment, distance A is at least 8 mm and distance B is at least 8 mm. In one embodiment, distance A is between 10 and 18 mm and distance B is between 13 and 19 mm.

The description above has generally been with respect to separation lines overlapping one another such that the adjacent low adhesion zone overlaps the underlying low adhesion zone. It is understood that an underlap may achieve the same objective. In such an embodiment, the low adhesion zone may be secured by the underlying adhesive. Preferably in this embodiment, the separation line of the outermost sheet is secured by the underlying adhesive.

Although specific embodiments of this invention have been shown and described herein, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

Examples

Test Method for Lanemarking

Tendency to lanemark on a particular surface was determined using the following test: A roll of test tape was placed on a roller handle or floor roller tool, and any cover wrap was removed. The distance from the free end of the sheet to the end of the low adhesion zone (distance A) was measured with a ruler and recorded. The side sectional distance from the free end of the sheet to the start of the next underlying low adhesion zone (distance B) was measured and recorded. When the free end of the tape did not completely overlay the low adhesion zone on the next sheet, the distance B was recorded as a negative number. Using moderate force, the tape roll was rolled across the test surface, back and forth, at least twice, using a stroke distance of two or three feet. If the lint tape unwound from the roller and stuck to the test surface during the test, the recorded lanemark score was 1, otherwise the score was recorded as 0. To continue with additional tests, the used top sheet and any sheets that may have unwound were removed, and the test was repeated with freshly exposed tape.

Example Lint Tape Rolls 1-19

Lint tapes were prepared having the properties shown in Table 1. The tape backings (cast polypropylene) and the adhesive compositions (synthetic rubber-resin based) that were used were similar to that used for the Scotch™ Lint Roller product (available from 3M Company, St. Paul, Minn.). The adhesive coatings covered the entire width of the lint tape, except for an approximately 0.25 inch longitudinal strip left uncoated at each edge.

TABLE 1

| Lint Tape | Peel Adhesion to Steel[1] (ounces/inch width) | Roll Unwind Force[2] (ounces/roll width) | Adhesive Coating Weight (grains/24 inch$^2$) |
|---|---|---|---|
| A | 32.3 | 10.4 | 3.7 |
| B | 30.4 | 5.7 | 3 |
| C | 44.7 | 10.2 | 3.6 |
| D | 48.3 | 11.6 | 3.4 |
| E | 85.5 | 6 | 4 |

[1]Peel Adhesion to Steel was measured according to PSTC 101, Test Method A (Pressure Sensitive Tape Council, 15th Edition, 2007).
[2]Roll Unwind Force was measured according to PSTC 8 (Pressure Sensitive Tape Council, 15th Edition, 2007).

Each lint tape was printed with green printing ink (Graflex pH Neutral 376 Green, KMB-10376-AD, available from Kohl & Madden Printing Ink Corporation, Carlstadt, N.J., a member of the Sun Chemical Group) to fully cover the adhesive coating in the center of the tape, resulting in rectangular detackified low adhesion zones extending across the width of the lint tape, at fixed downweb intervals. The printed lint tapes were then converted into 4 inch or 8 inch wide coreless lint rolls (1.75 inch inner diameter) of varying lengths. Coreless lint tape rolls are described and disclosed in U.S. Pat. No. 5,878,457. The lint tape rolls were perforated during converting using techniques known in the art such that the perforation or separation lines occurred within the low adhesion zones, similar to the low adhesion zones shown on the lint tape roll shown in FIGS. 7 and 8. Lint tape rolls having printed areas registered with the perforation lines are described and disclosed in U.S. Patent Publication No. 2006/0003129, the disclosure of which is incorporated herein by reference. With tape printed at fixed intervals such as this, the innermost layers on the roll each had low adhesion zones overwrapping the underlying low adhesion zone by some distance. As the roll diameter and circumference increase, the overlap distance decreases, and the free end of the sheet may lie on top of or may not even reach the underlying low adhesion zone.

The lint tape rolls were then evaluated for their tendency for lanemarking as described above. The data obtained for 4 inch wide lint tape rolls (Examples 1-8) are given in Table 2. The data obtained for 8 inch wide lint tape rolls (Examples 9-19) are given in Table 3.

TABLE 2

Four inch wide lint tape roll

| Example | Test Surface | Lint Tape Sample | Printed Stripe Length (inches) | Distance A (mm) | Distance B (mm) | Lane-Mark (0 = no, 1 = yes) |
|---|---|---|---|---|---|---|
| 1 | 0.5" pile carpet | E | 0.5 | 4 | 1 | 1 |
| | | | | 4 | 1 | 1 |
| | | | | 5 | 5 | 0 |
| | | | | 3 | 6 | 0 |
| | | | | 5 | 7 | 0 |
| | | | | 3 | 8 | 0 |
| | | | | 5 | 9 | 0 |
| | | | | 3 | 10 | 0 |
| 2 | 0.5" pile carpet | E | 0.5 | 6 | 4 | 0 |
| | | | | 4 | 6 | 0 |
| | | | | 6 | 6 | 0 |
| | | | | 4 | 7 | 0 |
| | | | | 6 | 8 | 0 |
| | | | | 4 | 8 | 0 |
| | | | | 6 | 8 | 0 |
| 3 | vinyl floor tile | E | 0.75 | 14 | 3 | 0 |
| | | | | 16 | 3 | 0 |
| | | | | 14 | 5 | 0 |
| | | | | 16 | 5 | 0 |
| | | | | 14 | 6 | 0 |
| | | | | 16 | 6 | 0 |
| 4 | vinyl floor tile | E | 0.75 | 6 | −10 | 0 |
| | | | | 6 | −11 | 1 |
| | | | | 6 | −8 | 1 |
| | | | | 6 | −8 | 1 |
| | | | | 7 | 0 | 0 |
| | | | | 8 | −1 | 1 |
| | | | | 7 | 1 | 0 |
| | | | | 6 | 3 | 0 |
| | | | | 7 | 2 | 0 |
| | | | | 6 | 5 | 0 |
| | | | | 7 | 4 | 0 |
| | | | | 6 | 6 | 0 |
| 5 | vinyl floor tile | C | 0.5 | 7 | −3 | 1 |
| | | | | 7 | −1 | 1 |
| | | | | 6 | −2 | 1 |
| | | | | 7 | 3 | 0 |
| | | | | 8 | 3 | 1 |
| | | | | 8 | 5 | 0 |
| | | | | 7 | 8 | 0 |
| | | | | 8 | 8 | 0 |
| | | | | 7 | 10 | 0 |
| | | | | 7 | 9 | 0 |
| | | | | 7 | 11 | 0 |
| 6 | vinyl floor tile | C | 0.5 | 10 | 0 | 1 |
| | | | | 10 | 2 | 0 |
| | | | | 11 | 1 | 0 |
| | | | | 10 | 3 | 0 |
| | | | | 9 | 0 | 1 |
| | | | | 11 | 4 | 0 |
| | | | | 10 | 5 | 0 |
| | | | | 10 | 5 | 0 |
| | | | | 10 | 8 | 0 |
| | | | | 11 | 7 | 0 |
| | | | | 10 | 9 | 0 |

TABLE 2-continued

| Four inch wide lint tape roll | | | | | | |
|---|---|---|---|---|---|---|
| Example | Test Surface | Lint Tape Sample | Printed Stripe Length (inches) | Distance A (mm) | Distance B (mm) | Lane-Mark (0 = no, 1 = yes) |
| 7 | vinyl floor tile | C | 0.75 | 7 | −4 | 1 |
| | | | | 8 | −2 | 1 |
| | | | | 10 | 0 | 1 |
| | | | | 8 | 3 | 0 |
| | | | | 11 | 3 | 0 |
| | | | | 9 | 5 | 0 |
| | | | | 11 | 5 | 0 |
| | | | | 10 | 8 | 0 |
| | | | | 12 | 7 | 0 |
| 8 | vinyl floor tile | C | 0.75 | 8 | −1 | 1 |
| | | | | 10 | 2 | 1 |
| | | | | 9 | 4 | 0 |
| | | | | 7 | 6 | 0 |
| | | | | 8 | 5 | 0 |
| | | | | 7 | 8 | 0 |
| | | | | 9 | 8 | 0 |
| | | | | 7 | 10 | 0 |

TABLE 3

| Eight inch wide lint tape roll | | | | | | |
|---|---|---|---|---|---|---|
| Example | Test Surface | Lint Tape Sample | Printed Stripe Length (inches) | Distance A (mm) | Distance B (mm) | Lane-Mark (0 = no, 1 = yes) |
| 9 | vinyl floor tile | A | 0.75 | 15 | 24 | 0 |
| | | | | 16 | 26 | 0 |
| | | | | 15 | 25 | 0 |
| | | | | 14 | 26 | 0 |
| | | | | 13 | 26 | 0 |
| 10 | vinyl floor tile | B | 0.75 | 12 | 21 | 0 |
| | | | | 12 | 21 | 0 |
| | | | | 12 | 22 | 0 |
| | | | | 11 | 23 | 0 |
| | | | | 12 | 25 | 0 |
| 11 | vinyl floor tile | B | 0.75 | 6 | 15 | 0 |
| | | | | 5 | 15 | 0 |
| | | | | 5 | 16 | 0 |
| | | | | 5 | 17 | 0 |
| | | | | 6 | 18 | 0 |
| 12 | vinyl floor tile | D | 0.75 | 15 | 24 | 0 |
| | | | | 15 | 25 | 0 |
| | | | | 14 | 25 | 0 |
| | | | | 15 | 26 | 0 |
| | | | | 14 | 27 | 0 |
| 13 | vinyl floor tile | C | 0.75 | 16 | 25 | 0 |
| | | | | 16 | 25 | 0 |
| | | | | 16 | 26 | 0 |
| | | | | 15 | 27 | 0 |
| | | | | 18 | 29 | 0 |
| 14 | 0.5" pile carpet | A | 0.75 | 13 | 22 | 0 |
| | | | | 14 | 25 | 0 |
| | | | | 13 | 24 | 0 |
| | | | | 15 | 26 | 0 |
| | | | | 15 | 28 | 0 |
| 15 | 0.5" pile carpet | A | 0.75 | 15 | 25 | 0 |
| | | | | 16 | 26 | 0 |
| | | | | 15 | 27 | 0 |
| | | | | 16 | 29 | 0 |
| | | | | 14 | 26 | 0 |

TABLE 3-continued

| Eight inch wide lint tape roll | | | | | | |
|---|---|---|---|---|---|---|
| Example | Test Surface | Lint Tape Sample | Printed Stripe Length (inches) | Distance A (mm) | Distance B (mm) | Lane-Mark (0 = no, 1 = yes) |
| 16 | 0.5" pile carpet | B | 0.75 | 8 | 18 | 0 |
| | | | | 7 | 16 | 0 |
| | | | | 7 | 18 | 0 |
| | | | | 7 | 18 | 0 |
| | | | | 6 | 18 | 0 |
| 17 | 0.5" pile carpet | B | 0.75 | 14 | 23 | 0 |
| | | | | 13 | 23 | 0 |
| | | | | 14 | 24 | 0 |
| | | | | 13 | 24 | 0 |
| | | | | 14 | 27 | 0 |
| 18 | 0.5" pile carpet | C | 0.75 | 17 | 26 | 0 |
| | | | | 17 | 27 | 0 |
| | | | | 18 | 29 | 0 |
| | | | | 17 | 28 | 0 |
| | | | | 18 | 30 | 0 |
| 19 | 0.5" pile carpet | D | 0.75 | 15 | 24 | 0 |
| | | | | 16 | 26 | 0 |
| | | | | 15 | 26 | 0 |
| | | | | 16 | 27 | 0 |
| | | | | 15 | 28 | 0 |

Example Lint Tape Rolls 20-35

Example Lint Rolls 20-35 were prepared in order to determine whether the lint rollers required a low adhesion zone along the entire leading edge of the tape roll.

Lint tape samples were prepared having the properties shown in Table 4. The tape backings (cast polypropylene) and the adhesive compositions (synthetic rubber-resin based) that were used were similar to that used for the Scotch™ Lint Roller product (available from 3M Company, St. Paul, Minn.). The adhesive coatings covered the entire width of the tape, except for an approximately 0.25 inch longitudinal strip left uncoated at each edge.

TABLE 4

| Lint Tape | Peel Adhesion to Steel[1] (ounces/inch width) | Roll Unwind Force[2] (ounces/roll width) | Adhesive Coating Weight (grains/24 inch$^2$) |
|---|---|---|---|
| F | 25.2 | 15.9 | 4.8 |
| G | 17.1 | 11.9 | 4.2 |
| H | 15.6 | 9.3 | 3.3 |
| I | 19.5 | 10.0 | 3.5 |

[1]Peel Adhesion to Steel was measured according to PSTC 101, Test Method A (Pressure Sensitive Tape Council, 15th Edition, 2007).
[2]Roll Unwind Force was measured according to PSTC 8 (Pressure Sensitive Tape Council, 15th Edition, 2007).

The lint tapes were then wound into stock rolls for further converting. These stock rolls were converted and made into coreless progressively printed and perforated lint rolls using techniques known in the art. Progressively perforated lint tape rolls are described and disclosed in U.S. Pat. No. 5,763,038, and lint tape rolls having printed areas registered with the perforation lines are described and disclosed in U.S. Patent Publication No. 2006/0003129. The lint rolls were printed and perforated during converting such that each low adhesion zone had a 1/32 inch wide or 3/32 inch wide unprinted area or gap extending along the length of the low adhesion zone, at the center between the edges of the tape, and such that the perforation or separation lines occurred within the low adhesion zones as shown in FIGS. 9 and 10. The same green printing ink as described above was used to detackify the adhesive. The printed length of each low adhesion zone was 0.75 inches, the printed width of each low adhesion zone was 7.75 inches, and all rolls were 8 inches wide.

The lint rolls were then evaluated for their tendency for lanemarking as described above. The data obtained are given in Table 5.

TABLE 5

| Example | Test Surface | Lint Tape | Gap Width (inches) | Distance A (mm) | Distance B (mm) | Lane-Mark (0 = no, 1 = yes) |
|---|---|---|---|---|---|---|
| 20 | vinyl floor tile | F | 1/32 | 16 | 17 | 0 |
| | | | | 17 | 16 | 0 |
| | | | | 16 | 16 | 0 |
| | | | | 17 | 15 | 0 |
| | | | | 15 | 17 | 0 |
| 21 | 0.5" pile carpet | F | 1/32 | 16 | 17 | 0 |
| | | | | 17 | 16 | 0 |
| | | | | 16 | 17 | 0 |
| | | | | 17 | 16 | 0 |
| | | | | 16 | 16 | 0 |
| 22 | vinyl floor tile | F | 3/32 | 16 | 16 | 0 |
| | | | | 17 | 16 | 0 |
| | | | | 17 | 16 | 1 |
| | | | | 15 | 15 | 0 |
| | | | | 17 | 16 | 0 |
| 23 | 0.5" pile carpet | F | 3/32 | 17 | 16 | 0 |
| | | | | 17 | 16 | 0 |
| | | | | 17 | 16 | 0 |
| | | | | 17 | 16 | 0 |
| | | | | 18 | 17 | 0 |
| 24 | vinyl floor tile | G | 1/32 | 16 | 16 | 0 |
| | | | | 17 | 16 | 0 |
| | | | | 17 | 17 | 0 |
| | | | | 17 | 16 | 0 |
| | | | | 16 | 16 | 0 |
| 25 | 0.5" pile carpet | G | 1/32 | 17 | 16 | 0 |
| | | | | 16 | 16 | 0 |
| | | | | 17 | 16 | 0 |
| | | | | 16 | 16 | 0 |
| | | | | 16 | 15 | 0 |
| 26 | vinyl floor tile | G | 3/32 | 16 | 16 | 0 |
| | | | | 16 | 15 | 0 |
| | | | | 16 | 16 | 0 |
| | | | | 15 | 15 | 0 |
| | | | | 16 | 16 | 0 |
| 27 | 0.5" pile carpet | G | 3/32 | 16 | 16 | 0 |
| | | | | 16 | 16 | 0 |
| | | | | 16 | 16 | 0 |
| | | | | 15 | 15 | 0 |
| | | | | 15 | 15 | 0 |
| 28 | vinyl floor tile | H | 1/32 | 17 | 16 | 0 |
| | | | | 16 | 16 | 0 |
| | | | | 17 | 16 | 0 |
| | | | | 16 | 16 | 0 |
| | | | | 18 | 17 | 0 |
| 29 | 0.5" pile carpet | H | 1/32 | 18 | 17 | 0 |
| | | | | 17 | 17 | 0 |
| | | | | 17 | 16 | 0 |
| | | | | 18 | 17 | 0 |
| | | | | 17 | 17 | 0 |
| 30 | vinyl floor tile | H | 3/32 | 15 | 15 | 0 |
| | | | | 17 | 15 | 0 |
| | | | | 16 | 15 | 0 |
| | | | | 17 | 15 | 0 |
| | | | | 15 | 14 | 0 |

TABLE 5-continued

| Example | Test Surface | Lint Tape | Gap Width (inches) | Distance A (mm) | Distance B (mm) | Lane-Mark (0 = no, 1 = yes) |
|---|---|---|---|---|---|---|
| 31 | 0.5" pile carpet | H | 3/32 | 16 | 15 | 0 |
| | | | | 16 | 15 | 0 |
| | | | | 16 | 15 | 0 |
| | | | | 15 | 14 | 0 |
| | | | | 16 | 15 | 0 |
| 32 | vinyl floor tile | I | 1/32 | 15 | 15 | 0 |
| | | | | 17 | 16 | 0 |
| | | | | 15 | 16 | 0 |
| | | | | 16 | 15 | 0 |
| | | | | 17 | 16 | 0 |
| 33 | 0.5" pile carpet | I | 1/32 | 15 | 15 | 0 |
| | | | | 16 | 16 | 0 |
| | | | | 15 | 15 | 0 |
| | | | | 19 | 18 | 0 |
| | | | | 15 | 15 | 0 |
| 34 | vinyl floor tile | I | 3/32 | 15 | 14 | 0 |
| | | | | 16 | 16 | 0 |
| | | | | 15 | 14 | 0 |
| | | | | 14 | 14 | 0 |
| | | | | 15 | 16 | 0 |
| 35 | 0.5" pile carpet | I | 3/32 | 15 | 15 | 0 |
| | | | | 15 | 14 | 0 |
| | | | | 15 | 15 | 0 |
| | | | | 12 | 11 | 0 |
| | | | | 16 | 15 | 0 |

Although the data are not presented here, similar results were obtained when the lint tape rolls were tested against glass, PERGO® laminate flooring, and office cubicle type carpeting having a tight weave and low profile.

What is claimed is:

1. A tape defining opposing first and second side edges, a first longitudinal end and a second longitudinal end opposite the first longitudinal end, the tape formed into a roll having a plurality of wraps arranged to define an upweb direction from the first longitudinal end to the second longitudinal end, the second longitudinal end located at an interior of the roll, the tape comprising:

a backing having a first side and a second side;

an adhesive on the first side of the backing;

a plurality of separation lines separating the tape into discrete sheets including an outermost sheet and a second sheet immediately upweb of the outermost sheet and separated from the outermost sheet by a first separation line of the plurality of separation lines, the first separation line defining a trailing edge of the outermost sheet and a leading edge of the second sheet;

a plurality of low adhesion zones on the first side of the backing, each separation line extending within an associated low adhesion zone, and each of the plurality of low adhesion zones encompassing at least 90% of a width of the tape between the opposing side edges, wherein the low adhesion zone has a lower adhesion than the adhesive;

wherein when formed as a roll, each separation line and associated low adhesion zone is offset from an immediately next upweb low adhesion zone associated with an immediately next upweb separation line, wherein the outermost sheet is wound onto itself and a leading edge of the outermost sheet being offset from a leading edge of the second sheet, the low adhesion zone associated with the leading edge of the outermost sheet overlaps the low adhesion zone associated with the first separation line and is circumferentially offset from the low adhesion zone associated with the first separation line, the overlapping low adhesion zone removably secured to the adhesive on the underlying outermost sheet.

2. The tape of claim 1, wherein the low adhesion zone is a detackified area of the adhesive.

3. The tape of claim 1, wherein the low adhesion zone is an uncoated portion of the backing and therefore does not include adhesive.

4. The tape of claim 1, wherein the low adhesion zone is discontinuous in extension between the first side edge of the tape and the second side edge of the tape.

5. The tape of claim 1, wherein the low adhesion zone extends along at least 90% of a length of the corresponding separation line.

6. The tape of claim 1, wherein the low adhesion zone extends along at least 98% of a length of the corresponding separation line.

7. The tape of claim 1, wherein the low adhesion zone extends upweb from the corresponding separation line at least a distance of 8 millimeters.

8. The tape of claim 1, wherein a side sectional distance from each separation line to an immediately next upweb low adhesion zone is greater than a distance the immediately next low adhesion zone extends in the upweb direction along the tape from the corresponding separation line.

9. The tape of claim 8, wherein the side sectional distance from the separation line to the immediately next upweb low adhesion zone is at least 10 mm.

10. The tape of claim 1, wherein when formed as a roll, the second side of the backing contacts the adhesive of an underlying wrap along an entirety of the leading edge of the outermost sheet.

11. The tape of claim 1, when formed as a roll, the first separation line is covered by the outermost sheet.

12. The tape of claim 1, wherein when formed as a roll, the first separation line is covered by the outermost sheet.

13. The tape of claim 1, wherein an adhesive level of the plurality of low adhesion zones is greater than no adhesion.

* * * * *

UNITED STATES PATENT AND TRADEMARK OFFICE

CERTIFICATE OF CORRECTION

PATENT NO. : 8,168,280 B2
APPLICATION NO. : 12/044153
DATED : May 1, 2012
INVENTOR(S) : John Lee Thiele It is certified that error appears in the above-identified patent and that said Letters Patent is hereby corrected as shown below:

Column 14

Lines 15-16 In Claim 11, after "claim 1," delete "when formed as a roll, the first separation line is covered by the outermost sheet." and insert -- wherein when formed as a roll, the first low adhesion zone associated with the first separation line is entirely covered by the outermost sheet. --, therefor.

Signed and Sealed this
Twenty-eighth Day of August, 2012

David J. Kappos

David J. Kappos
*Director of the United States Patent and Trademark Office*